US006524176B1

(12) United States Patent
Cheng et al.

(10) Patent No.: US 6,524,176 B1
(45) Date of Patent: Feb. 25, 2003

(54) POLISHING PAD

(75) Inventors: Chih-Hsien Cheng, Chang-Hua Hsien (TW); Yuh-Turng Liu, Kao-Hsiung Hsien (TW)

(73) Assignee: Macronix International Co. Ltd., Hsin-Chu (TW)

( * ) Notice: Subject to any disclaimer, the term of this patent is extended or adjusted under 35 U.S.C. 154(b) by 0 days.

(21) Appl. No.: 10/063,136

(22) Filed: Mar. 25, 2002

(51) Int. Cl.[7] ..... B24D 11/00

(52) U.S. Cl. ..... 451/526; 451/6; 451/8; 451/9; 451/41; 451/63; 451/287; 451/283

(58) Field of Search ..... 451/6, 8, 9, 41, 451/63, 287, 283, 526, 527

(56) References Cited

U.S. PATENT DOCUMENTS 5,433,651 A * 7/1995 Lustig et al. ..... 451/6

6,045,439 A * 4/2000 Birang et al. ..... 451/526

* cited by examiner

*Primary Examiner*—Joseph J. Hail, III
*Assistant Examiner*—Shantese McDonald
(74) *Attorney, Agent, or Firm*—Winston Hsu

(57) ABSTRACT

A polishing pad has a first layer, a second layer, a hole and a plug. The hole is formed in the polishing pad and has a first section in the first layer of the polishing pad and a second section in a second layer of the polishing pad. The plug is embedded in the hole and has an upper portion and a lower portion. The upper portion of the plug fits into the first section of the hole, and the lower portion of the plug fits into the second section of the hole. Since the plug has a height of the polishing pad, the problem of depositions, such as water droplets, has been solved. The endpoint detection can thus be precisely controlled.

14 Claims, 2 Drawing Sheets

POLISHING PAD

BACKGROUND OF INVENTION

1. Field of the Invention

The invention relates to a polishing pad, and more particularly, to a polishing pad with a plug having a height of the polishing pad.

2. Description of the Prior Art

When fabricating modern semiconductor integrated circuits (ICs), to prevent subsequent manufacturing processes from being adversely affected, the flatness of each deposition layer of an integrated circuit has to be considered. In fact, most high-density IC fabrication techniques make use of some method to form a planarized wafer surface at critical points in the manufacturing process. One method for achieving semiconductor wafer planarization or topography removal is the chemical mechanical polishing (CMP) process. The CMP process is a well-known technique for removing materials on a semiconductor wafer using a polishing device and polishing slurry. The combination of the mechanical movement of the polishing device relative to the wafer and the chemical reaction of the polishing slurry provides an effective abrasive force with chemical erosion to planarize the exposed surface of the wafer or a layer formed on the wafer.

Please refer to FIG. 1 . FIG. 1 is a schematic diagram of a portion of a prior art CMP apparatus 10. The CMP apparatus 10 includes a polishing platen 12 covered with a polishing pad 14. The polishing pad 14 comprises a covering layer 16 and a backing layer 18. The backing layer 18 serves as an interface between the covering layer 16 and the polishing platen 12. The covering layer 16 is used in conjunction with polishing slurry 20 to polish a semiconductor wafer 22 placed on the polishing platen 12. Furthermore, a window 24 is formed in the covering layer 16 and an aperture 26 is formed below the window 24 in the backing layer 18. This window 24 is positioned such that it has a view of the semiconductor wafer 22 held by a polishing head during a portion of a platen's rotation. A laser interferometer 28 is fixed below the polishing platen 12 in a position enabling a laser beam to pass through the window 24 and then strike the surface of the overlying semiconductor wafer 22 during a time when the window 24 is adjacent the semiconductor wafer 22. Thereafter, the CMP apparatus 10 analyzes the reflected laser beam from the semiconductor wafer 22 to determine the endpoint of the CMP process.

However, there may be residues of the polishing slurry, by-products of the CMP process, or condensed water droplets deposited on the bottom surface of the window 24 in the prior art CMP apparatus 10. Thus, the laser beam traveling through the window 24 is scattered by the deposits. That is, either the laser beam emitted from the laser interferometer 28 or the laser beam reflected from the semiconductor wafer 22 is attenuated. Consequently, the endpoint detection of the CMP process is interfered with and the planarization of the semiconductor wafer 22 cannot be achieved.

SUMMARY OF INVENTION

It is therefore a primary objective of the claimed invention to provide a polishing pad to solve the above-mentioned problem.

According to the claimed invention, a polishing pad is disclosed. The polishing pad has a first layer, a second layer, a hole and a plug. The hole is formed in the polishing pad and has a first section in the first layer of the polishing pad and a second section in a second layer of the polishing pad. The plug is embedded in the hole and has an upper portion and a lower portion. The upper portion of the plug fits into the first section of the hole, and the lower portion of the plug fits into the second section of the hole.

It is an advantage of the claimed invention that the polishing pad has the plug with a height of the polishing pad so as to eliminate the interference of residues of polishing slurry or condensed water droplets deposited onto the bottom surface of the plug. Thus, the endpoint of a CMP process can be precisely determined. Consequently, the yield of the manufacturing process for integrated circuits is substantially improved and the cost of fabrication is significantly reduced.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
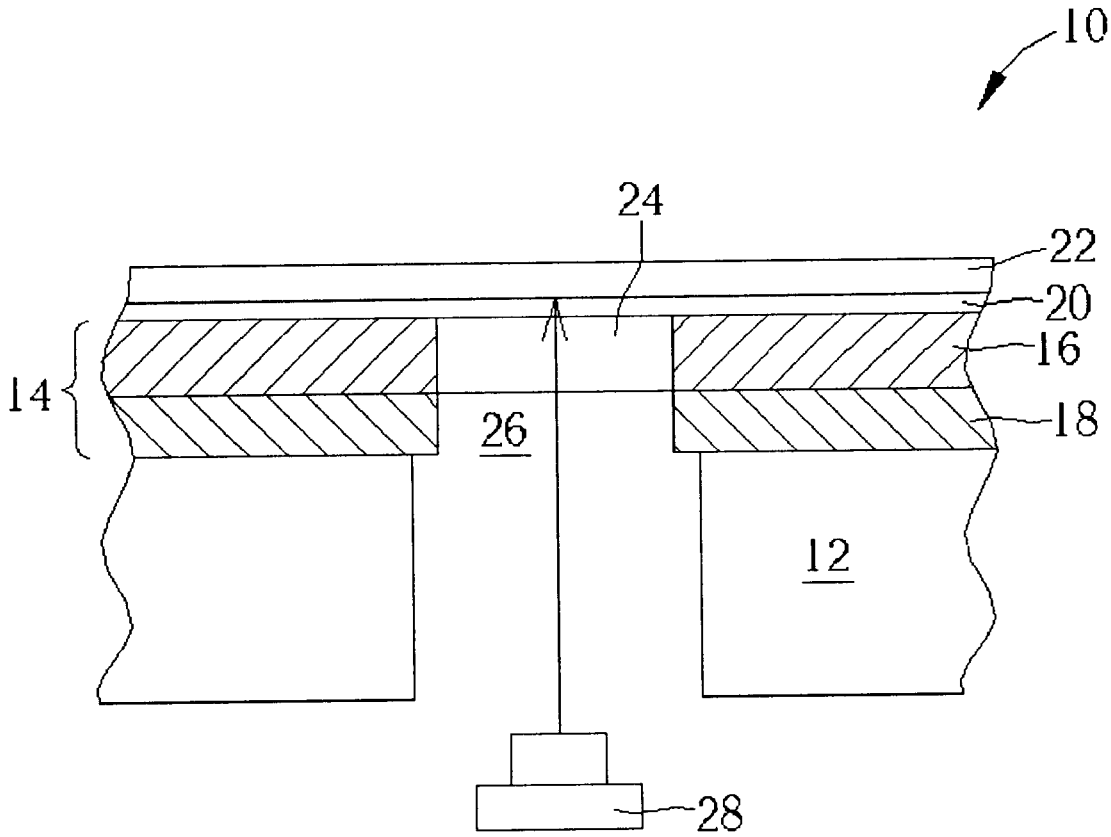
Fig. 1 Prior art
FIG. 1 is a schematic diagram of a chemical mechanical polishing (CMP) apparatus according to a prior art.
Figure 2:
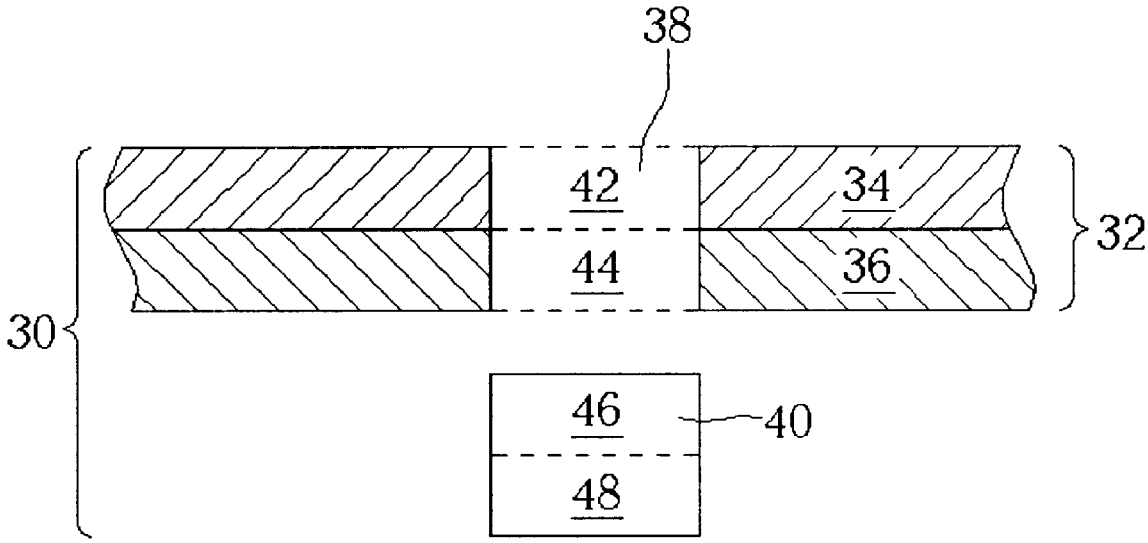
FIG. 2 is a schematic diagram of a CMP apparatus according to the present invention.

Please refer to FIG. 2. FIG. 2 is a schematic diagram of a partial structure 30 of a chemical mechanical polishing (CMP) apparatus according to the present invention. Since the feature of the present invention is the improvement of a polishing pad, other elements in the CMP apparatus are the same as those of the prior art CMP apparatus 10 and are thus not required to describe herein. As shown in FIG. 2, a polishing pad 32 of the CMP apparatus has a first layer 34 and a second layer 36. The first layer 34 is a covering layer used in conjunction with polishing slurry to polish a semiconductor wafer disposed on a polishing platen. According to a preferred embodiment of the present invention, the covering layer is composed of discontinuous foam. The second layer 36 is a backing layer that interfaces with the polishing pad 14 and the polishing platen. According to the preferred embodiment of the present invention, the backing layer is composed of continuous foam.

Furthermore, the polishing pad 32 comprises a hole 38 formed in the polishing pad 32 and a plug 40 capable of being embedded in the hole 38 so as to be used as a window of the polishing pad 32. The hole 38 further comprises a first section 42 in the first layer 34 of the polishing pad 32 and a second section 44 in a second layer 36 of the polishing pad 32. The plug 40 has an upper portion 46 and a lower portion 48. The upper portion 46 of the plug 40 fits into the first section 42 of the hole 38, and the lower portion 48 of the plug 40 fits into the second section 44 of the hole 38. Additionally, the plug 40 according to the present invention has approximately a height of the hole 38, i.e., a height of the polishing pad 32. That is, a thickness of the plug 40 according to the present invention is approximately equal to a sum of a thickness of the first layer 34 of the polishing pad 32 and a thickness of the second layer 36 of the polishing pad 32. Incidentally, for convenient illustration, dotted lines depicted the hole 38 in FIG. 2 are merely used to show the positions of the hole 38 and the related portions of the hole 38 corresponding to the first layer 34 and the second layer 36 of the polishing pad 32, and do not represent that the hole 38 has a real body.

According to the preferred embodiment of the present invention, the plug 40 is a solid plug. Thus, the plug 40 is required to be composed of transparent material so that a laser beam emitted from a laser interferometer positioned below the polishing platen is not interfered with by the plug 40. Meanwhile, the transparent material is also chemically inert with respect to the CMP process. That is, the transparent material cannot react with the polishing slurry or the semiconductor wafer. Surely, the plug 40 may be a hollow plug as well. Furthermore, a cross-sectional area of the first section 42 of the hole 38 shown in FIG. 2 is the same as a cross-sectional area of the second section 44 of the hole 38. Nevertheless, within the spirit of the present invention, the cross-sectional area of the first section 42 of the hole 38 may also be different from a cross-sectional area of the second section 44 of the hole 38. In this case, the plug 40 is required to change correspondingly according to the shape and size of the hole 38.

Since there may be residues of the polishing slurry, by-products of the CMP process, or condensed water droplets deposited on the interface between the covering layer and the backing layer of the typical polishing pad, the bottom surface of the prior art window in the CMP apparatus has deposits of the residuals when the prior art window only has a height of the covering layer. Thus, a laser beam traveling through the prior art window is scattered by the depositions. That is, either the laser beam emitted from the laser interferometer or the laser beam reflected from a semiconductor wafer is attenuated. Consequently, the endpoint detection of the CMP process is interfered with and the planarization of the semiconductor wafer cannot be achieved.

In contrast to the prior art CMP apparatus, the plug of the polishing pad according to the present invention extends through the covering layer to the bottom surface of the backing layer so as to eliminate the interference of residues of polishing slurry or condensed water droplets deposited onto the bottom surface of the plug. Thus, the endpoint of the CMP process can be precisely determined. Consequently, the yield of the manufacturing process for integrated circuits is substantially improved and the cost of fabrication is significantly reduced.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A polishing pad comprising:

a first layer;

a second layer;

a hole formed in the polishing pad, the hole having:

a first section in the first layer of the polishing pad; and a second section in the second layer of the polishing pad; and a hollow plug embedded in the hole;

wherein the hollow plug has an upper portion and a lower portion, and the upper portion of the hollow plug fits into the first section of the hole, and the lower portion of the hollow plug fits into the second section of the hole.

2. The polishing pad of claim 1 wherein the first layer is a covering layer and the second layer is a backing layer.

3. The polishing pad of claim 2 wherein the covering layer is composed of discontinuous foam and the backing layer is composed of continuous foam.

4. The polishing pad of claim 1 wherein the plug is a solid plug.

5. The polishing pad of claim 4 wherein the plug is composed of transparent material.

6. The polishing pad of claim 1 wherein a cross-sectional area of the first section of the hole is the same as a cross-sectional area of the second section of the hole.

7. The polishing pad of claim 1 wherein a cross-sectional area of the first section of the hole is different from a cross-sectional area of the second section of the hole.

8. The polishing pad of claim 1 wherein a thickness of the plug is approximately equal to a sum of a thickness of the first layer of the polishing pad and a thickness of the second layer of the polishing pad.

9. A chemical mechanical polishing (CMP) polishing pad comprising:

a covering layer;

a backing layer;

a hole formed in the polishing pad, the hole having:

a first section in the covering layer of the polishing pad; and a second section in the backing layer of the polishing pad; and a hollow plug embedded in the hole;

wherein the hollow plug has an upper portion and a lower portion, and the upper portion of the hollow plug fits into the first section of the hole and the lower portion of the hollow plug fits into the second section of the hole, and a thickness of the hollow plug is approximately equal to a sum of a thickness of the covering layer of the polishing pad and a thickness of the backing layer of the polishing pad.

10. The polishing pad of claim 9 wherein the covering layer is composed of discontinuous foam and the backing layer is composed of continuous foam.

11. The polishing pad of claim 9 wherein the plug is a solid plug.

12. The polishing pad of claim 11 wherein the plug is composed of transparent material.

13. The polishing pad of claim 9 wherein a cross-sectional area of the first section of the hole is the same as a cross-sectional area of the second section of the hole.

14. The polishing pad of claim 9 wherein a cross-sectional area of the first section of the hole is different from a cross-sectional area of the second section of the hole.

* * * * *